US005773401A

United States Patent [19]

Murata et al.

[11] Patent Number: 5,773,401

[45] Date of Patent: Jun. 30, 1998

[54] DETERGENT COMPOSITION CONTAINING POLYCARBOXYLATE AGENT HAVING SPECIFICALLY DEFINED PARAMETERS

[75] Inventors: Susumu Murata, Amagasaki, Japan; David Johnathan Kitko, Cincinnati, Ohio; Toshiko Shigematsu, Nara, Japan

[73] Assignee: The Procter & Gamble Company, Cincinnati, Ohio

[21] Appl. No.: 750,445

[22] PCT Filed: May 30, 1995

[86] PCT No.: PCT/US95/06812

§ 371 Date: Feb. 28, 1997

§ 102(e) Date: Feb. 28, 1997

[87] PCT Pub. No.: WO95/33815

PCT Pub. Date: Dec. 14, 1995

[30] Foreign Application Priority Data

Jun. 3, 1994 [AU] Australia ..... PM6108

[51] Int. Cl.[6] ..... C11D 3/37; C11D 3/12; C11D 3/39; C11D 3/395

[52] U.S. Cl. ..... 510/361; 510/302; 510/309; 510/313; 510/315; 510/318; 510/434; 510/476; 510/507

[58] Field of Search ..... 510/476, 361, 510/533, 434, 302, 309, 313, 315, 318, 507; 252/245

[56] References Cited

PUBLICATIONS

English translation of JP 52–4510, published Jan. 13, 1977, Jul. 1995.

J5 2004–510; Nippon Shokubai Kag; Detergent Compsn-s.–Which Do Not Cause River Pollution; Jun. 3, 1975; 13817Y08, for JP 52–4510, Jan. 13, 1977.

*Primary Examiner*—Ardith Hertzog
*Attorney, Agent, or Firm*—Ken K. Patel; Kim W. Zerby; Jacobus C. Rasser

[57] ABSTRACT

Laundry detergent compositions comprise at least 10% detergent surfactant or at least 10% detergent builder system. The detergent builder system comprises a copolymer of maleic acid and acrylic acid having a molecular weight of from 5,000 to 15,000 and a mole ratio of acrylic units to maleic units of from about 3:7 to 7:3. The copolymer has an Index Ratio (IR) of not less than 110, wherein IR=Binding Index (BI)×Dispersing Index (DI)100.

12 Claims, No Drawings

DETERGENT COMPOSITION CONTAINING POLYCARBOXYLATE AGENT HAVING SPECIFICALLY DEFINED PARAMETERS

FIELD OF THE INVENTION

The present invention relates to a detergent composition comprising a specific polycarboxylate agent having excellent builder capacity for divalent alkali earth metals, which provides excellent clay soil removal and dispersion in laundering conditions.

BACKGROUND OF THE INVENTION

Polycarboxylates are commonly used in laundry detergent products and are well-known to provide soil dispersion, and calcium and magnesium hardness sequestration. Such polymers are can be polymerized carboxylic monomer, or salts thereof, such as polyacrylate and co-polymers of mono- or poly-carboxylic monomers, and salts thereof, such as those described in Japanese Patent Laid-Open No. 4510 (1977), issued to Nippon Shokubai KK, disclosing copolymers having a molecular weight between 300 and 10,000, Japanese Patent Publication No. 11789 (1969), Japanese Patent Publication No. 411791 (1969), U.S. Pat. No. 3,308,007 (Diehl, et al), issued Mar. 7, 1967, and EP Publication 0,080,222 (Procter & Gamble Company), Jun. 1, 1983), the disclosures of which are incorporated herein by reference.

However, the performance of such polycarboxylate polymers are not completely satisfactory. Known polycarboxylate agents which provide excellent clay soil dispersion have not been shown to also provide sufficient calcium or hardness binding capacity, especially in underbuilt wash conditions. By "underbuilt" is meant that there is insufficient calcium and magnesium sequestration capacity in the laundry detergent composition for the total amount of calcium and magnesium ions brought into the wash solution as wash water and from soils in the clothes to be laundered. Conversely, known polycarboxylate agents which provide excellent calcium and magnesium ion binding capacity have not been shown to also provide effective clay soil dispersion capability. Therefore, there remains a need for a laundering agent which can provide both excellent binding capacity for hardness ions and clay soil dispersion.

It has been discovered that the binding capacity and dispersion capability of polycarboxylate agents in the laundering process can be predicted by evaluation of the individual features of binding capacity and clay soil dispersion of the agent. It has further been discovered that polycarboxylate agents which exhibit a high clay soil dispersion capability and a high hardness binding capacity will provide excellent sequestration and soil dispersion performance under regular wash conditions. It has also been discovered that such polycarboxylate agents provide such clay soil dispersion capability even in underbuilt laundering conditions.

DETAILED DESCRIPTION OF THE INVENTION

The present invention includes laundry detergent composition comprising:

(i) at least 10% detergent surfactant; and (ii) at least 10% detergent builder system; said detergent builder system comprising a polycarboxylate agent having an Index Ratio (IR) of not less than 100, wherein IR=Binding Index (BI)×Dispersing Index (DI)/100. The Binding Index and the Dispersing Index of any particular polycarboxylate agent are determined in accordance with the test methods described hereinafter. In general, the higher the Index Ratio, the better the performance of the polymer under laundering conditions, especially in underbuilt conditions. Preferably the Index Ratio is not less than 110, more preferably not less than 120. Likewise, the Binding Index and the Dispersion Index are, independently, not less than 110, more preferably not less than 120.

Particularly preferred are copolymers of maleic acid and acrylic acid, and salts thereof Such polymers generally have the formula

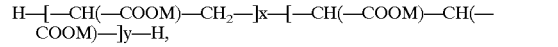

$$H—[—CH(—COOM)—CH_2—]x—[—CH(—COOM)—CH(—COOM)—]y—H,$$

wherein the molecular weight of said copolymer is from 5000 to 15,000, and the mole ratio R of x to y is from about 3:7 to 7:3, and where M is a counterion, preferably Na or K. Most preferably, the copolymer has a molecular weight between 6,000 and 12,000, and R is from 1:1 to 7:3.

The polycarboxylate agents can be made by methods well known in the art. Such methods are described in, for example, Japanese Patent Laid-Open No. 4510 (1977), issued to Nippon Shokubai KK.

Other Detergent Components

The detergent surfactant of the present invention is selected from anionic surfactant, nonionic surfactant, cationic surfactant, amphoteric surfactant and mixture thereof. The anionic surfactant can include secondary $C_{10}$–$C_{18}$ alcohol sulfates, $C_{10}$–$C_{18}$ alkylbenzene sulfonates, alkyl sulfates, and alkylethoxy sulfates, a-sulfofatty acid ester salts, fatty acid salts (soap) and olefinsulfonates. The nonionic surfactant can include $C_{10}$–$C_{16}$ alcohol ethoxylates comprising an alcohol having ethylene oxide added thereto, nonylphenol ethoxylate, adducts comprising an alcohol having propylene oxide and ethylene oxide added thereto, fatty acid alkanolamides, sucrose fatty acid esters, alkylamine oxides and polyhydroxy-fatty acid amides. The detergent surfactant of the present invention also can be selected from description of WO9218594 which is incorporated herein by reference.

The builder system preferably contains other builder ingredients in addition to the polycarboxylate. Such builders can include phosphate and non-phosphate calcium ion sequestering builders. The phosphate calcium ion sequestering builder can include sodium tripoly phosphate and sodium pyrophosphate as well as organic phosphonates and amino alkylene poly (alkylene phosphonates). Organic phosphonates and amino alkylene poly (alkylene phosphonates) include alkali metal ethane 1-hydroxy diphosphonates, nitrilo trimethylene phosphonates, ethylene diamine tetra methylene phosphonates and diethylene triamine penta methylene phosphonates, although these materials are less preferred where the minimisation of phosphorus compounds in the compositions is desired. The non-phosphate calcium ion sequestering builder can include alkali metal aluminosilicates, monomeric polycarboxylates, homo or copolymeric polycarboxylic acids or their salts in which the polycarboxylic acid comprises at least two carboxylic radicals separated from each other by not more than two carbon atoms, carbonates, silicates, citric acid and mixtures of any of the foregoing. Whilst a range of aluminosilicate ion exchange materials can be used, preferred sodium aluminosilicate zeolites have the unit cell formula

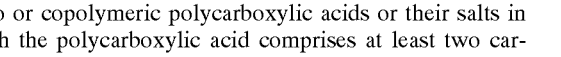

$$Na_r[(AlO_2)_r(SiO_2)_s]_tH_2O$$

wherein r and s are at least 6; the molar ratio of r to s is from 1.0 to 0.5 and t is at least 5, preferably from 7.5 to 276, more preferably from 10 to 264. The aluminosilicate materials are in hydrated form and are preferably crystalline, containing from 10% to 28%, more preferably from 18% to 22% water in bound form. The above aluminosilicate ion exchange materials are further characterised by a particle size diameter of from 0.1 to 10 micrometers, preferably from 0.2 to 4 micrometers. The term "particle size diameter" herein represents the average particle size diameter of a given ion exchange material as determined by conventional analytical techniques such as, for example, microscopic determination utilizing a scanning electron microscope or by means of a laser granulometer. The aluminosilicate ion exchange materials are further characterised by their calcium ion exchange capacity, which is at least 200 mg equivalent of $CaCO_3$ water hardness/g of aluminosilicate, calculated on an anhydrous basis, and which generally is in the range of from 300 mg eq./g to 352 mg eq./g. The aluminosilicate ion exchange materials herein are still further characterised by their calcium ion exchange rate which is at least 130 mg equivalent of $CaCO_3$/liter/minute/(g/liter) [2 grains $Ca^{++}$/gallon/minute/(gram/gallon)] of aluminosilicate (anhydrous basis), and which generally lies within the range of from 130 mg equivalent of $CaCO_3$/liter/minute/(gram/liter) [2 grains/gallon/minute/(gram/gallon)] to 390 mg equivalent of $CaCO_3$/liter/minute/(gram/liter) [6 grains/gallon/minute/(gram/gallon)], based on calcium ion hardness. Optimum aluminosilicates for builder purposes exhibit a calcium ion exchange rate of at least 260 mg equivalent of $CaCO_3$/liter/minute/(gram/liter) [4 grains/gallon/minute/(gram/gallon)]. Aluminosilicate ion exchange materials useful in the practice of this invention are commercially available and can be naturally occurring materials, but are preferably synthetically derived. A method for producing aluminosilicate ion exchange materials is discussed in U.S. Pat. No. 3,985,669. Preferred synthetic crystalline aluminosilicate ion exchange materials useful herein are available under the designations Zeolite A, Zeolite B, Zeolite X, Zeolite HS and mixtures thereof. In an especially preferred embodiment, the crystalline aluminosilicate ion exchange material is Zeolite A and has the formula $$Na_{12}[(AlO_2)_{12}(SiO_2)_{12}]x\cdot H_2O$$

wherein x is from 20 to 30, especially 27.

Other suitable water-soluble monomeric or oligomeric carboxylate builders can added in minor amounts. Such materials are described, by way of example, in Other suitable polycarboxylates are disclosed in U.S. Pat. No. 4,144,226, Crutchfield et al, issued Mar. 13, 1979, in U.S. Pat. No. 3,308,067, Diehl, issued Mar. 7, 1967, and U.S. Pat. No. 3,723,322, Diehl, hereby incorporated by reference.

The builder can include alkaline builders, such as metal silicates, alkaline metal carbonates and bicarbonate, and the like. In formula containing high levels of crystalline stratiform sodium silicate, to minimize the amount of ingredients contained in the product, such other builders and other alkali materials should be contained at less than about 50%, preferably less than 30% of the composition. Furthermore, the ratio R of crystalline stratiform sodium silicate to the sum of other builders and other alkaline materials should not be less than 0.34, preferably not less than 0.5, and more preferably not less than 1.

The dose of the detergent composition of the present invention (the amount by weight of the product used in to wash a batch of clothes) can be varied to achieve the desired cleaning performance under the user's washing conditions. The dose amount can vary from 25 g or less in countries like Japan where compactness and light weight products are preferable, to as high as 300–500 gm. Preferred are doses of 100 g or less, more preferably 50 g or less. In a preferred compact detergent composition, the dose is less than 25 g, preferably from 14 g to 21 g, and more preferably from 15 g to 20 g, per 30 liters of washing water.

Optional Detergent Components

The detergent composition of the present invention can contain a wide variety of other cleaning, fabric treatment, and processing agents to improve the overall cost, usage, and performance of a product containing the formula. Non-limiting examples of such materials are disclosed hereinafter.

Enzyme Stabilizers

The enzymes employed herein are stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Bleaching Compounds—Bleaching Agents and Bleach Activators

The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents or bleaching for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetra-hydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L. is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

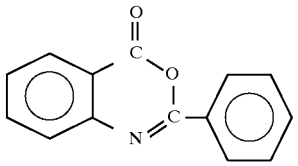

Still another class of preferred bleach activators includes the acyl lactam activators, especially acyl caprolactams and acyl valerolactams of the formulae:

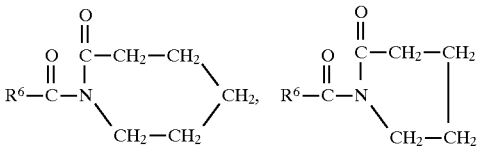

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}_2(u\text{-}O)_3$(1,4,7-trimethyl-1,4,7-triazacyclononane)$_2(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4(ClO_4)_4$, $Mn^{III}Mn^{IV}_4(u\text{-}O)_1(u\text{-}OAc)_2$-(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Adjunct Ingredients

The compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative examples of such adjunct materials.

Polymeric Soil Release Agent

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoarolyl, end-capped terephthalate esters.

If utilized, soil release agents will generally comprise from about 0.01% to about 10.0%, by weight, of the detergent compositions herein, typically from about 0.1% to about 5%, preferably from about 0.2% to about 3.0%.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions.

Clay Soil Removal/Anti-redeposition Agents

The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylates amines; liquid detergent compositions typically contain about 0.01% to about 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. These materials are well known in the art.

Brightener

Any optical brighteners or other brightening or whitening agents known in the art can be incorporated at levels typically from about 0.05% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, available from Hilton-Davis, located in Italy; the 2-(4-styryl-phenyl)-2H-napthol[1,2-d]triazoles; 4,4'-bis-(1,2,3-triazol-2-yl)-stil- benes; 4,4'-bis(styryl)bisphenyls; and the aminocoumarins. Specific examples of these brighteners include 4-methyl-7-diethyl-amino coumarin; 1,2-bis(-venzimidazol-2-yl)ethylene; 1,3-diphenyl-phrazolines; 2,5-bis(benzoxazol-2-yl)thiophene; 2-styryl-napth-[1,2-d] oxazole; and 2-(stilbene-4-yl)-2H-naphtho-[1,2-d]triazole. See also U.S. Pat. No. 3,646,015, issued Feb. 29, 1972 to Hamilton. Anionic brighteners are preferred herein.

Suds Suppressors

Compounds for reducing or suppressing the formation of suds can be incorporated into the compositions of the present invention. Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The tern "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

For any detergent compositions to be used in automatic laundry washing machines, suds should not form to the extent that they overflow the washing machine. Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Fabric Softeners

Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981.

Dye Transfer Inhibiting Agents

The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof The N—O group can be represented by the following general structures:

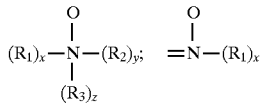

wherein $R_1$, $R_2$, $R_3$ are aliphatic, aromatic, heterocyclic or alicyclic groups or combinations thereof, x, y and z are 0 or 1; and the nitrogen of the N—O group can be attached or form part of any of the aforementioned groups. The amine oxide unit of the polyamine N-oxides has a pKa <10, preferably pKa <7, more preferred pKa <6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as ("PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis, Vol* 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

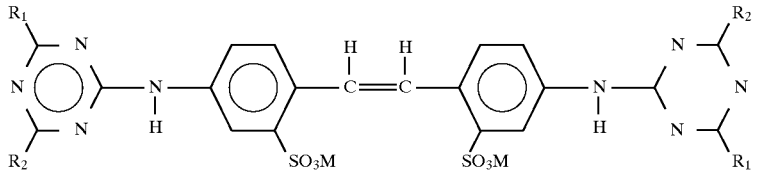

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4'-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds discussed above can optionally be used in the present compositions to provide conventional fabric "brightness" benefits, rather than a true dye transfer inhibiting effect.

Other Ingredients

A wide variety of other ingredients useful in detergent compositions can be included in the compositions herein, including other active ingredients, carriers, hydrotropes, processing aids, dyes or pigments, solvents for liquid formulations, solid fillers for bar compositions, etc.

The laundry detergent compositions of the present invention can be made by processes well known in the art, such as described in Japanese patent application 171,911, filed Jul. 12, 1994, the disclosure of which is incorporated by reference.

Test Methods

I. The Binding Capacity measurement

The following reagents and polycarboxylate sample solutions are prepared:

[1] Glycine buffer solution: 8.85 g of glycine and 6.90 g NaCl, 80 ml of 1N NaOH made up to 200 ml of buffer solution with deionized water.

[2] Calcium solution: 2.940 g of calcium chloride dihydrate diluted to 200 ml with deionized water (0.100M).

[3] Diluted buffer solution: A 20 ml volume of the [1] glycine buffer solution is diluted to a 1-L volume with deionized water.

[4] Polycarboxylate sample solution: A sample of the polycarboxylate is diluted to a 1% sample solution (as active) with deionized water.

The calcium binding meter is prepared as follows: A calcium ion selective electrode (Orion 93200) is conditioned as instructed by manufacture's literature. The [3] diluted buffer solution is allowed to equilibrate at 20° C. (±0.1° C.). An ion meter (Orion model 920A) is prepared with double junction electrode (#90020) and the calibrated ion selective electrode. 50 ml calibration solutions are prepared by diluting the [2] 0.100M calcium solution [3] the diluted buffer solution. Five of the 50-ml calibration solutions are prepared: 0.10 mM $Ca^{++}$, 0.20 mM $Ca^{++}$, 0.30 mM $Ca^{++}$, 0.40 mM $Ca^{++}$, and 0.50 mM $Ca^{++}$. The meter is calibrated in these five solutions.

The sample is measured as follows: 10 g of the [4] polycarboxylate sample solution is added to the 50-ml calibration solution at 0.50 mM $C^{++}$, and agitate with magnet stirrer (ca 600 rpm). The Ca concentration in the agitated solution is recorded at 3.0 min.

The binding capacity is calculated as follows:

Binding capacity of sample=0.5 mM-Ca concentration at 3 min.

The Binding Index is calculated as follows: A binding capacity of 0.34 mM is used as the standard or benchmark. The Binding Index (BI) is then:

Binding Index=(Binding capacity of sample/0.34)×100

II. Clay dispersing test method

The following reagents and polycarboxylate sample solutions are prepared:

[1] Glycine buffer solution: 67.56 g of glycine and 52.60 g NaCl, 60 ml of 1N NaOH made up to 600ml of buffer solution with deionized water. 60 g of above glycine buffer solution make is then diluted with ion exchanged water and make 1000 g dilute buffer solution.

[2] Polycarboxylate sample solution: A sample of the polycarboxylate agent is diluted with the above [1] dilute buffer solution to 50 ppm (as active).

1 g of clay (Kanto Loam) is placed into a standard test tube. 100 cc of the [2] sample solution is poured into the test tube. A lid (or paraffin film) is placed over the test tube. The lidded test tube is shaken well 20 times, ensuring that there is no clay sitting at the bottom of the test tube. The test tube is placed in a test tube stand and left to stand for 20 hours.

A photoelectrode is set up and calibrated as follows: A photoelectrode (DP550) is placed into a Titrator (Mettler DL25). Ion-exchanged water is placed into a plastic cup. The photoelectrode is placed into the water in the cup and left to set for 15 min. Then, the electric potential of the titrator is set for 1000 mV Sample dispersion measurement is made as follows: A horizontal line is drawn on the outside surface of the test tube (sitting in the test tube stand) corresponding to the vertical midpoint of solution in test tube. The photoelectrode is placed down into the test tube solution and is position at this midpoint line. When the mV reading output becomes stable, the millivolt reading (mV) is recorded.

The dispersing capacity is calculated as follows:

Dispersing capacity of sample=−1 n(mV/1000).

The Dispersing Index is calculated as follows: A dispersing capacity of 2.5 is used as the standard or benchmark. The Dispersing Index (DI) is then:

Dispersing Index (DI)=(Dispersing capacity of sample)/2.5*100.

The Index ratio (IR) of the polycarboxylate is calculated according to the equation:

Index Ratio (IR)=DI*BI/100

Next, the present invention will be explained by way of the following non-limiting examples.

EXAMPLES OF THE INVENTION

| | Sample No. 1 weight % | Sample No. 2 weight % | Sample No. 3 weight % |
|---|---|---|---|
| Surfactant | | | |
| Sodium $C_{12}$ linear alkylbenzene sulfonate (LAS) | 17.0 | 20.0 | 20.0 |
| Sodium $C_{14-15}$ alkylsulfate | 9.0 | 7.0 | 15.0 |
| $C_{12-14}$ polyoxyethylene alkyl ether | 2.0 | 3.0 | 3.0 |

-continued

| | Sample No. 1 weight % | Sample No. 2 weight % | Sample No. 3 weight % |
|---|---|---|---|
| $C_{12-18}$ alkyl soap | — | 2.0 | — |
| Builder and Alkaline Material | | | |
| SKS-6 (supplied by Hoechst AG) | 24.0 | — | 10.0 |
| Polycarboxylate Polymer A active | 5.0 | 6.0 | — |
| Polycarboxylate Polymer B active | — | — | 5.0 |
| Zeolite A | 6.0 | 8.0 | 6.0 |
| Sodium citrate | — | 3.0 | — |
| Sodium Carbonate | 5.0 | 20.0 | 10.0 |
| Sodium silicate (solids, 1.6 R) | — | 5.85 | — |
| Bleaching Component | | | |
| Nonanoyloxy benzene sulfonate (NOBS) particle[1] | 9.0 | 4.0 | 9.0 |
| Sodium Percarbonate (supplied by Tokai Denka Kogyo KK) | 9.0 | 4.0 | 9.0 |
| Others | | | |
| Polyvinylpyrrolidone (PVP) | 0.30 | 0.30 | 0.30 |
| Polyethylene glycol (molecular weight 4000) (PEG 4000) | 0.5 | 1.0 | 0.5 |
| Moisture, enzymes, perfume, optical brighteners, sodium sulfate, etc. | Balance | Balance | Balance |

EXAMPLES OF THE INVENTION

| | Sample No. 4 weight % | Sample No. 5 weight % |
|---|---|---|
| Surfactant | | |
| Sodium $C_{12}$ linear alkylbenzene sulfonate (LAS) | 10 | — |
| Sodium $C_{14-15}$ alkylsulfate | 5 | 13 |
| Alkylethoxylsulfate | 2 | 4 |
| $C_{12-14}$ polyoxyethylene alkyl ether | 0.5 | 9 |
| Alkyl-N-methyl-glucamide | — | 3 |
| $C_{12-18}$ alkyl soap | — | — |
| Builder and Alkaline Material | | |
| SKS-6 (supplied by Hoechst AG) | — | 9 |
| Polycarboxylate Polymer A active | 6 | 5 |
| Polycarboxylate Polymer B active | — | — |
| Zeolite A | 24 | 11 |
| Sodium citrate | — | 2 |
| Sodium Carbonate | 15 | 9 |
| Sodium silicate (solids, 1.6 R) | 1 | — |
| Sodium Diethylenetriaminepentaacetate | 1 | — |
| Sodium Diethylenetriaminepentamethylenephosphate | — | 1 |
| Bleaching Component | | |
| Nonanoyloxy benzene sulfonate (NOBS) particle[1] | 5 | — |
| Sodium Percarbonate (supplied by Tokai Denka Kogyo KK) | 3 | 20 |
| Tetraacethyl ethylenediamine | — | 2 |
| Others | | |
| Polyvinylpyrrolidone (PVP) | — | 0.05 |
| Polyethylene glycol (molecular weight 4000) (PEG 4000) | 3 | — |
| Sodium sulfate | 20 | — |
| Moisture, enzymes, perfume, optical brighteners, sodium sulfate, etc. | Balance | Balance |

[1]Stabilized, extruded particle containing 80% NOBS, and 20% of PEG 4000 and LAS.

Polycarboxylate Sample A is a copolymer known as "OL-9" from Nippon Shokubai KK., and is a copolymer of maleic acid and acrylic acid, having a molecular weight of 11,000, a mole ratio of acrylic:maleic of 60:40, a BI=122, a DI=122, and a IR=149.

Polycarboxylate Sample B is a copolymer known as "KH4" from Nippon Shokubai KK., and is a copolymer of maleic acid and acrylic acid, having a molecular weight of 12,000, a mole ratio of acrylic:maleic of 55:45, a BI=119, a DI=106, and a IR=126.

When the sample shown above as Sample No. 1 is used at 666 ppm in wash water at 20° C. and 3 grains hardness per gallon (as $CO_3$–), followed by rinsing, better clay soil cleaning and whiteness maintenance is achieved as compared to a washing under the same conditions and the same formula except that the Polycarboxylate Sample A is replaced with an equal amount by weight of a conventional polycarboxylate known as "ML-7" supplied by Nippon Shokubai KK., which is a copolymer of maleic acid and acrylic acid, having a molecular weight of 6500, a mole ratio of acrylic:maleic of 70:30, a BI=100, a DI=100, and a IR=100.

We claim:

1. A laundry detergent composition, comprising:

(i) at least 10% detergent surfactant; and (ii) at least 10% detergent builder system comprising a copolymer of maleic acid and acrylic acid of the formula $$H—[—CH(—COOM)—CH_2—]_x—[CH(—COOM)—CH(—COOM)—]_y-H$$

wherein M is a counterion, the molecular weight (MW) of the copolymer is from 5000 to 15,000, and the mole ratio R of x to y is from about 3:7 to 7:3, and further wherein the copolymer has an Index Ratio (IR) of not less than 110, wherein IR=Binding Index (BI)×Dispersing Index (DI)/100.

2. A laundry detergent composition according to claim 1 wherein said Binding Index is not less than 100.

3. A laundry detergent composition according to claim 2 wherein said Dispersing Index is not less than 100.

4. A laundry detergent composition according to claim 3 wherein said Binding Index is not less than 110.

5. A laundry detergent composition according to claim 4 wherein MW is from 6,000 to 12,000.

6. A laundry detergent composition according to claim 5 wherein R is from 1:1 to 7:3.

7. A laundry detergent composition according to claim 1 wherein MW is from 6,000 to 12,000.

8. A laundry detergent composition as defined by claim 1, wherein the Index Ratio is not less than 120.

9. A laundry detergent composition as defined by claim 1, wherein the builder system further comprises a zeolite builder.

10. A laundry detergent composition as defined by claim 1, further comprising a bleaching component.

11. A laundry detergent composition as defined by claim 10, wherein the bleaching component comprises a percarbonate.

12. A laundry detergent composition as defined by claim 11, wherein the bleaching component further comprises a bleach activator.

* * * * *